United States Patent [19]

Neuhierl

[11] 4,154,019

[45] May 15, 1979

[54] MARKER CONE DISPLAY SYSTEM FOR MODEL CAR TRACKS

[76] Inventor: Hermann Neuhierl, Waldstrasse 36, D-851o Fürth, Bayern, Fed. Rep. of Germany

[21] Appl. No.: 779,598

[22] Filed: Mar. 21, 1977

[30] Foreign Application Priority Data

Apr. 29, 1976 [DE] Fed. Rep. of Germany ... 7613592[U]

[51] Int. Cl.[2] ..... A63H 33/26

[52] U.S. Cl. ..... 46/236; 46/239

[58] Field of Search ..... 46/1 K, 236, 239, 240; 273/86 G, 136 B; 238/10 A, 10 B

[56] References Cited

U.S. PATENT DOCUMENTS

| | | | |
|---|---|---|---|
| 2,431,827 | 12/1947 | Rado | 46/236 |
| 2,665,913 | 1/1954 | Hlavac | 46/236 |
| 3,210,080 | 10/1965 | Rael et al. | 273/136 B |
| 3,471,151 | 10/1969 | Pfenninger | 46/239 |

FOREIGN PATENT DOCUMENTS

| | | | |
|---|---|---|---|
| 669125 | 3/1952 | United Kingdom | 273/86 C |

*Primary Examiner*—Louis G. Mancene
*Assistant Examiner*—Robert F. Cutting
*Attorney, Agent, or Firm*—Haseltine, Lake & Waters

[57] ABSTRACT

A system for providing an array of marker cones on a model track for model vehicles comprises a plurality of scaled down marker cones, a permanent magnetic material being arranged on the underside of the track surface and/or on the underside of the bases of the marker cones and a magnetizable material being provided on the underside of the bases of the marker cones or on the underside of the track so as to enable the marker cones to be magnetically held on the track.

8 Claims, 3 Drawing Figures

MARKER CONE DISPLAY SYSTEM FOR MODEL CAR TRACKS

Figure 1:
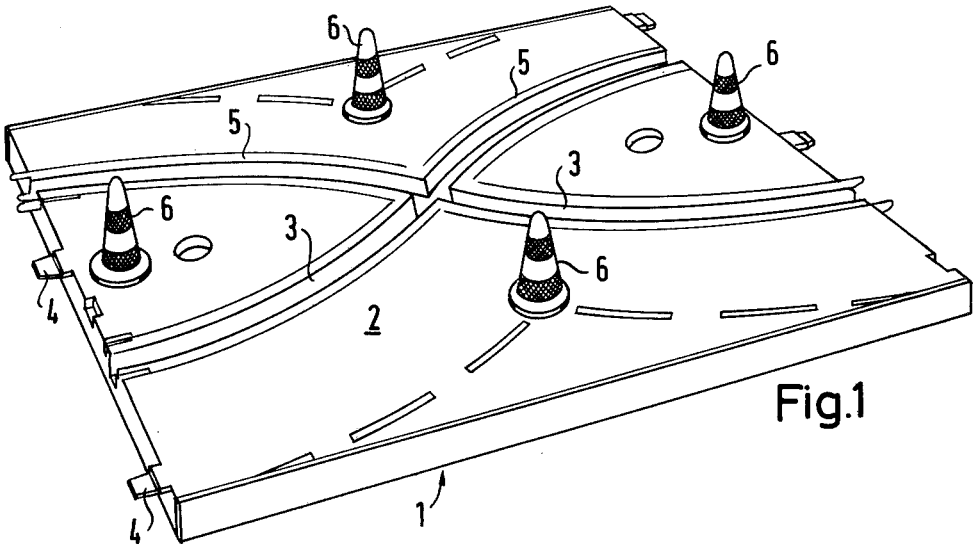

This invention relates to a system for providing an array of marker cones on a model car track.

Lane patterns on roads are frequently changed temporarily by means of tapered cones which are usually formed of elastomeric material. These tapered cones have a conspicuous colouration, usually having horizontal red and white rings, and are laid on the roadway in lines in accordance with the required lane marking. The tapered marked cones are usually quite stable and if necessary an annular base part may be provided therearound to project out from the main conical surface to ensure that the centre of gravity of the cone is sufficiently low.

It is frequently desirable that analogous cones may be provided on model tracks for running model cars. For example such tracks may be employed in tests of driving skill when it is necessary to simulate the lane layout on a normal road and accordingly it must be possible for corresponding miniturised marker cones to be fixed in different positions on the model racing track. However, for this purpose, it is not sufficient merely to scale down marker cones of conventional construction since they do not stand with satisfactory stability on the model car track sections. The problem which arises when the marker cones are scaled down is that their weight becomes so small that it is not sufficient to enable them to stand with satisfactory stability on the model track. Moreover, vehicles travelling on racing tracks produce considerable vibrations which cause the marker cones to move on the track surface. It might be thought possible to achieve a realistic simulation of normal events by firmly fixing the marker cones on the track sections, for example at specific points, by provision of openings and pegs in the bases of the cones. However this is not feasible since in fact it is desirable for the cones to be displaced or overturned by contact with a model vehicle as in real practice.

It is an object of this invention to provide a system whereby scaled down marker cones may be arranged on model car tracks in such a way that they are normally stable, but may be displaced or overturned by contact with a model vehicle.

According to the present invention, there is provided a system for providing an array of marker cones on a model track for model vehicles, which comprises a plurality of scaled down marker cones, a permanent magnetic material being arranged on the underside of the track surface and/or on the underside of the bases of the marker cones and a magnetisable material being provided on the underside of the bases of the marker cones or on the underside of the track so as to enable the marker cones to be magnetically held on the track. In this way, a sufficiently stable but releasable attachment is provided between the marker cones and the track. Since the model track sections are usually formed by extrusion from thermoplastic plastics material, the lines of force produced by the permanent magnetic material readily penetrate the track surface. It is particularly preferred that the permanent magnetic material take the form of small plates attached at intervals to the underside of the track, so that marker cones having a magnetisable material on the underside of their bases may be set up at these points.

Figure 2:
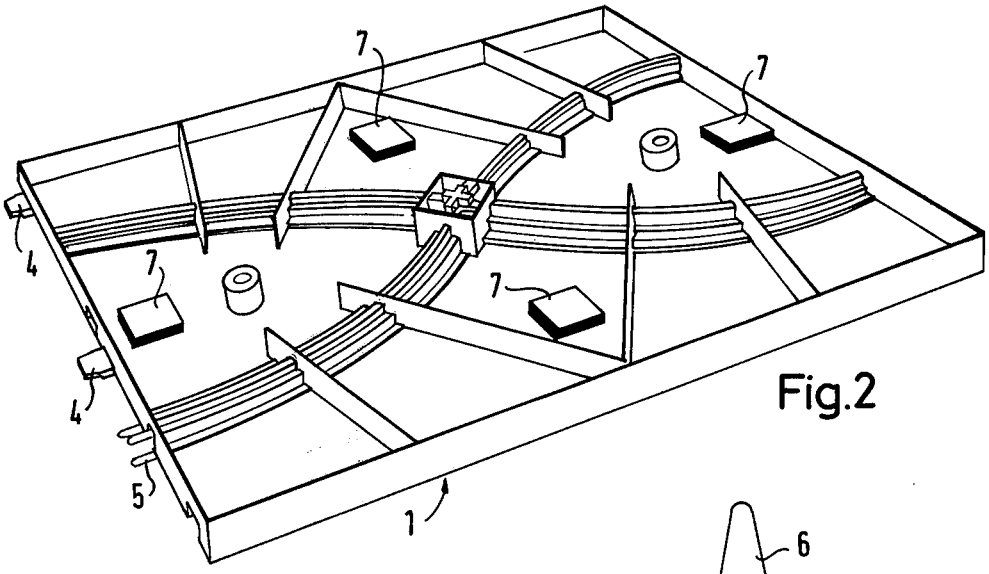
Figure 3:
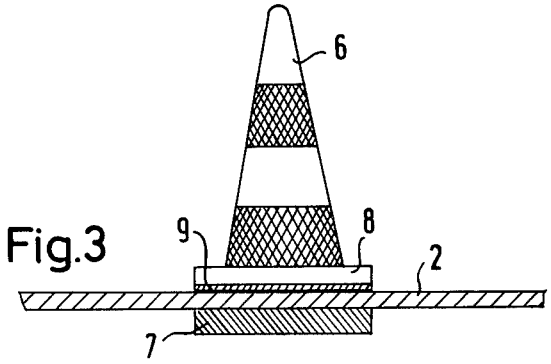

For a better understanding of this invention, and to show how the same can be carried into effect, reference will now be made, by way of example only, to the accompanying drawing, wherein FIG. 1 is a perspective view of a section of track having a system of scaled down marker cones in accordance with this invention;

FIG. 2 shows a view in perspective from below of the section of track shown in FIG. 1; and FIG. 3 shows partly in section a scaled down marker cone being held on model vehicle track.

Referring to FIGS. 1 and 2 of the drawings, a section of track for a model roadway comprises an extruded synthetic plastics component 1 providing a track surface 2 and having guide grooves 3 for model vehicles to travel thereon, connecting lugs 4 for connecting the section to a following section, and conventional contact strips 5. The track section shown possesses a layout on which vehicles travelling will have to change their drive lanes. Thus a slalom stretch is obtained by putting several similar sections of track together. Marker cones 6 are set upon the track surface 2. The marker cones are of conical form in accordance with usual road traffic management practice and have a coloured ring formation to render them readily visible. FIGS. 2 and 3 show that small plates 7 of permanent magnetic material are attached to the underside of the track surface 2 and the cones 6 have a layer of magnetisable material, for example a layer of metal 9 on the underside of their base part which is given the reference numeral 8. As can be seen from FIG. 3, the marker cone 6 is held in position by the permanent magnet plate 7, whose lines of force pass readily through the track surface 2 so that a sufficiently secure mounting of the cone 6 on the track surface 2 is obtained which nevertheless does not hinder the toppling over of the cones when impacted by a model vehicle, in use.

I claim:

1. A model track arrangement for model vehicles, comprising a plurality of scaled down marker cones, a permanent magnetic material and a magnetisable material, one of the permanent magnetic material and the magnetisable material being arranged on one of the underside of the track surface and the underside of the basis of the marker cones and the other being arranged on the other of the underside of the track surface and the underside of the basis of the marker cones, for holding marker cones magnetically on the track, said cones being held on said track magnetically to retain said cones in stable upright position.

2. A model track arrangement as claimed in claim 1, comprising a plurality of small plates of permanent magnetic material for arrangement on the underside of the track surface in displaceable manner in accordance with the positions which the marker cones are to be given on the upper surface of the track.

3. A model track arrangement as claimed in claim 1, wherein the magnetisable material takes the form of a thin metal layer on the underside of the base region of each marker cone.

4. A model track arrangement as claimed in claim 1, wherein the marker cones comprise a base region formed of magnetisable material.

5. A model car track section having plates of permanent magnetic material fixedly disposed at intervals on the underside thereof, scaled down marker cones having a magnetisable material on the underside thereof and standing on the upper surface of the track section over said plates, said cones being held on said track magnetically to retain said cones in stable upright position.

6. A model car track section as claimed in claim 5, wherein the magnetisable material takes the form of a thin metal layer on the underside of a base region of each marker cone.

7. A model car track section as claimed in claim 5, wherein the marker cones comprise a base region formed of magnetisable material.

8. A model track arrangement as defined in claim 1, wherein said model track is comprised of extruded synthetic plastics having guide grooves for model vehicles to travel thereon, connecting lugs for connecting adjacent sections of said track, said marker cones having a conical shape and having a colored ring formation for rendering said cone visible, magnetic flux passing through said track surface for securely holding said cones in upright position without preventing toppling of said cones when impacted by a traveling model vehicle.

* * * * *